US009161395B2

(12) United States Patent
Lambert

(10) Patent No.: US 9,161,395 B2
(45) Date of Patent: Oct. 13, 2015

(54) INSTRUMENT FOR PERFORMING MICROWAVE-ASSISTED REACTIONS

(75) Inventor: Joseph J. Lambert, Charlotte, NC (US)

(73) Assignee: CEM Corporation, Matthews, NC (US)

( * ) Notice: Subject to any disclaimer, the term of this patent is extended or adjusted under 35 U.S.C. 154(b) by 6 days.

(21) Appl. No.: 13/173,534

(22) Filed: Jun. 30, 2011

(65) Prior Publication Data

US 2013/0001221 A1 Jan. 3, 2013

(51) Int. Cl.

| | |
|---|---|
| ***H05B 6/64*** | (2006.01) |
| ***H05B 6/68*** | (2006.01) |
| ***H05B 6/80*** | (2006.01) |

(52) U.S. Cl.

CPC ..... *H05B 6/806* (2013.01); *H05B 6/645* (2013.01); *H05B 6/6441* (2013.01); *H05B 6/6447* (2013.01); *H05B 6/6464* (2013.01)

(58) Field of Classification Search

CPC .... H05B 6/6441; H05B 6/6447; H05B 6/806; H05B 6/645

USPC ..... 219/710–711, 702–703, 716, 718, 746, 219/747, 750–751, 682, 695–697; 422/21; 332/108

See application file for complete search history.

(56) References Cited

U.S. PATENT DOCUMENTS

| | | | | |
|---|---|---|---|---|
| 4,323,773 | A | 4/1982 | Carpenter | |
| 5,285,041 | A | 2/1994 | Wright | |
| 5,426,280 | A | 6/1995 | Smith | |
| 5,796,080 | A | 8/1998 | Jennings et al. | |
| 5,919,389 | A * | 7/1999 | Uehashi et al. | 219/711 |
| 5,945,684 | A * | 8/1999 | Lam et al. | 250/492.3 |
| 5,988,877 | A | 11/1999 | Hochrad et al. | |
| 6,084,226 | A * | 7/2000 | Greene et al. | 219/718 |
| 6,953,919 | B2 * | 10/2005 | Clothier | 219/620 |
| 6,989,519 | B2 | 1/2006 | Collins, Jr. et al. | |
| 2002/0101310 | A1 | 8/2002 | Jennings | |
| 2005/0045625 | A1 | 3/2005 | Collins, Jr. et al. | |
| 2007/0075069 | A1 * | 4/2007 | Musial | 219/497 |

(Continued)

FOREIGN PATENT DOCUMENTS

| | | | |
|---|---|---|---|
| CN | 2848351 | Y | 12/2006 |
| DE | 40 23 483 | A1 | 2/1991 |
| EP | 0 467 625 | A2 | 1/1992 |

(Continued)

OTHER PUBLICATIONS

European Search Report of foreign counterpart Application No. EP 12174329.8 mailed Sep. 26, 2012.

(Continued)

*Primary Examiner* — Quang Van

(74) *Attorney, Agent, or Firm* — Parsons Summa

(57) ABSTRACT

An instrument for performing microwave-assisted reactions typically includes (i) a microwave-radiation source, (ii) a cavity, (iii) a waveguide in microwave communication with the microwave-radiation source and the cavity, (iv) at least one reaction-vessel sensor for determining the number and/or type of reaction vessels positioned within the cavity, (v) an interface, and (vi) a computer controller. The computer controller is typically in communication with the interface, the microwave-radiation source, and the reaction-vessel sensor. The computer controller is typically capable of determining the output of the microwave-radiation source in response to the number and/or type of reaction vessels positioned within the cavity.

9 Claims, 4 Drawing Sheets

(56) References Cited

U.S. PATENT DOCUMENTS

| | | | | |
|---|---|---|---|---|
| 2010/0006562 | A1 * | 1/2010 | Clothier | 219/494 |
| 2010/0187224 | A1 | 7/2010 | Hyde et al. | |

FOREIGN PATENT DOCUMENTS

| | | | | |
|---|---|---|---|---|
| JP | 3-124104 | A | | 12/1991 |
| JP | H4-145428 | A | | 5/1992 |
| JP | H05248748 | A | | 9/1993 |
| JP | 09232072 | A | * | 9/1997 |
| JP | 2001-83134 | A | | 3/2001 |
| JP | 2005-95887 | A | | 4/2005 |
| JP | 2006-035056 | A | | 2/2006 |
| JP | 2010-184230 | A | | 8/2010 |
| WO | 97/13136 | A1 | | 4/1997 |
| WO | 98/15825 | A2 | | 4/1998 |
| WO | 99/14568 | A1 | | 3/1999 |
| WO | 99/54033 | A1 | | 10/1999 |
| WO | 00/49838 | A1 | | 8/2000 |
| WO | 2008/118999 | A2 | | 10/2008 |
| WO | 2010/025010 | A2 | | 3/2010 |

OTHER PUBLICATIONS

Search Report for counterpart ROC Taiwan Patent Application No. 101123631 dated Oct. 2, 2014.

Chemical Instrument, ISBN 7 5025-5528-5, Chemical Industry Press, May 2004; Chapter 7, pp. 14 [English Translation].

* cited by examiner

INSTRUMENT FOR PERFORMING MICROWAVE-ASSISTED REACTIONS

BACKGROUND

The present invention relates to devices and methods for performing automated microwave-assisted chemical and physical reactions.

"Microwave-assisted chemistry" refers to the use of electromagnetic radiation within the microwave frequencies to initiate, accelerate, or otherwise control chemical reactions. As used herein, the term "microwaves" refers to electromagnetic radiation with wavelengths of between about 1 millimeter (mm) and 1 meter (m). By way of comparison, infrared radiation is generally considered to have wavelengths from about 750 nanometers (nm) to 1 millimeter, visible radiation has wavelengths from about 400 nanometers to about 750 nanometers, and ultraviolet radiation has wavelengths of between about 1 nanometer and 400 nanometers. These various boundaries are, of course, exemplary rather than limiting.

Since its commercial introduction, microwave-assisted chemistry has been used for relatively robust chemical reactions, such as the digestion of samples in strong mineral acids. Other early commercial uses of microwave-assisted chemistry included (and continues to include) loss-on-drying analysis. More recently, commercially available microwave-assisted instruments have been able to enhance more sophisticated or more delicate reactions including organic synthesis and peptide synthesis.

In microwave-assisted chemistry, users typically program a microwave apparatus with respect to certain variables (e.g., microwave power or desired reaction temperature) to ensure that the desired reaction (e.g., a particular digestion or synthesis reaction) is carried out properly. Even in robust reactions such as digestion, the proper microwave power and reaction temperature can vary depending upon the sample size, the size of the vessel containing a sample, and the number of vessels. Moreover, different types of vessels can have differing temperature and pressure capabilities, which can be influenced, for example, by the mechanical robustness and venting capabilities of varying types of vessels.

Generally speaking, users must select, and in some cases experimentally determine, the proper microwave power in view of these variable as well as their own judgment and experience.

Although developing parameters experimentally can be helpful, it also raises the possibility of introducing user error into the microwave-assisted reaction. In many analysis techniques, this introduced error will be carried through and reflected in a less accurate or less precise analysis result. In other circumstances, such as during those reactions that require or generate high temperatures and high pressures, a mistake in the experimental or manual setting of the instrument could cause a failure of the experiment or even of the instrument, including physical damage.

As another less dramatic factor, the need to repeatedly enter manual information or carry out manual steps in a microwave-assisted context reduces the speed at which experiments can be carried out. This delay can reduce process efficiency in circumstances where microwave techniques provide the advantage (or in some cases meet the need) of carrying out large numbers of measurements on a relatively rapid basis. By way of example, real-time analysis of ongoing operations may be desired. Therefore, the closer to real time that a sample can be identified or characterized (or both), the sooner any necessary corrections can be carried out and thus minimize any wasted or undesired results in the process being monitored.

Accordingly, a need exists for a microwave apparatus that minimizes or eliminates the risk of user error and that increases the efficiency of microwave-assisted chemistry.

SUMMARY

In one aspect, the present invention embraces an instrument for performing microwave-assisted reactions that includes a microwave-radiation source, a cavity, and a waveguide in microwave communication with the microwave-radiation source and the cavity. The instrument typically includes at least one reaction-vessel sensor for determining the number and/or type of reaction vessels positioned within the cavity. The instrument typically includes an interface (e.g., a display and one or more input devices).

The instrument also typically includes a computer controller, which is in communication with the interface, the microwave-radiation source, and the reaction-vessel sensor. The computer controller is capable of initiating, adjusting, or maintaining the output of the microwave-radiation source in response to the number and/or type of reaction vessels positioned within the cavity, as well as in response to other factors such as the temperature or pressure within a reaction vessel.

In another aspect, the present invention embraces a method of performing microwave-assisted reactions. The method includes positioning one or more reaction vessels within a cavity. Typically, the reaction vessels are substantially transparent to microwave radiation. The method also includes detecting the number and/or type of reaction vessels using at least one reaction-vessel sensor. After a desired reaction is selected (e.g., by a user), the vessels and their contents are irradiated with microwaves. A computer controller determines the microwave power in response to (i) the number and/or type of reaction vessels and (ii) the desired reaction.

The foregoing illustrative summary, as well as other exemplary objectives and/or advantages of the invention, and the manner in which the same are accomplished, are further explained within the following detailed description and its accompanying drawing.

DETAILED DESCRIPTION

In one aspect, the present invention embraces a device (e.g., instrument) for performing automated microwave-assisted reactions.

Figure 1:
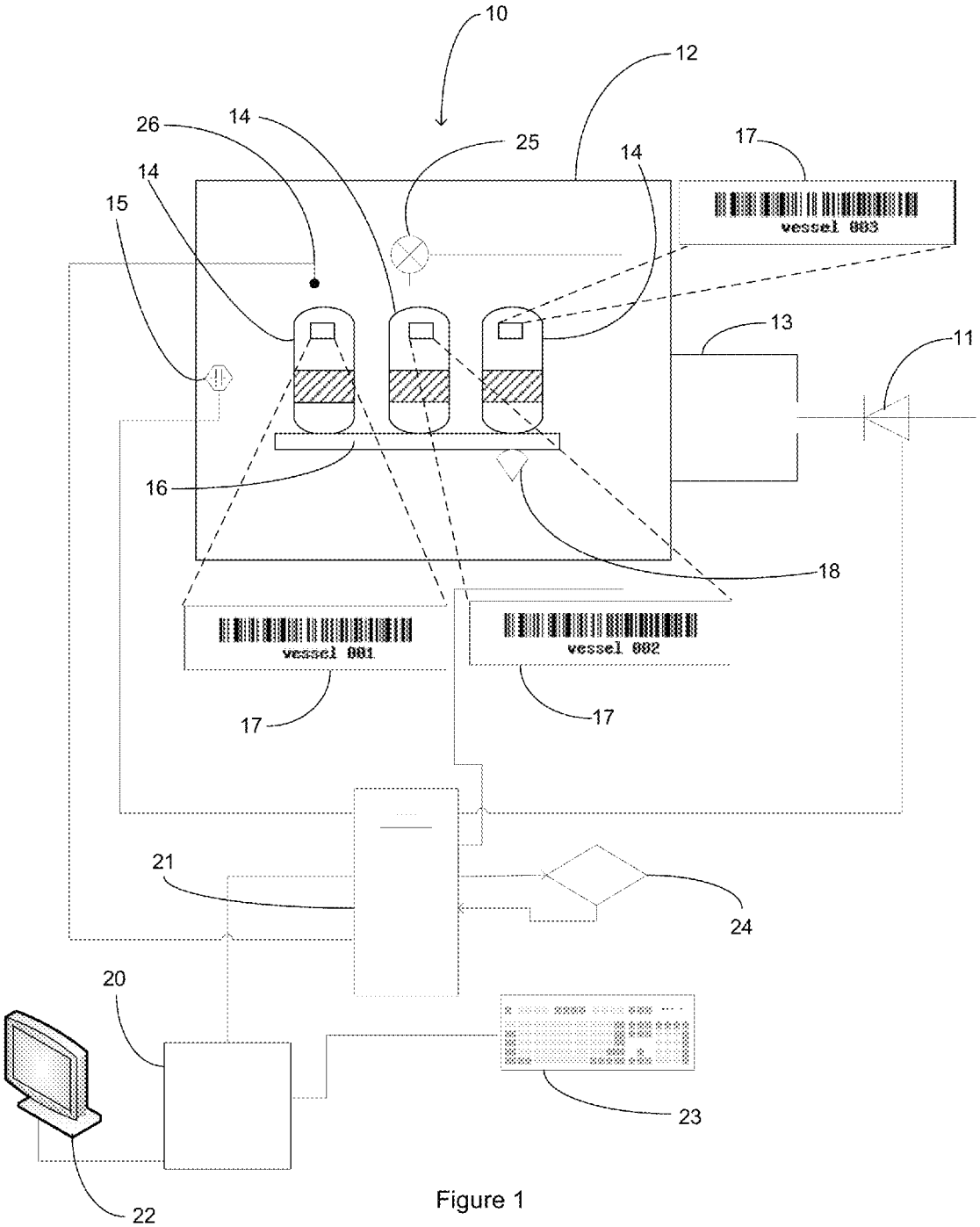
FIG. 1 depicts a diagram of a microwave instrument in accordance with the present invention.

Accordingly, and as depicted in FIG. 1, in one embodiment the present invention embraces a microwave instrument 10 that includes (i) a source of microwave radiation, illustrated in FIG. 1 by the diode symbol at 11, (ii) a cavity 12, and (iii) a waveguide 13 in microwave communication with the source 11 and the cavity 12.

The source of microwave radiation 11 may be a magnetron. That said, other types of microwave-radiation sources are within the scope of the present invention. For example, the source of microwave radiation may be a klystron, a solid-state device, or a switching power supply. In this regard, the use of a switching power supply is described in commonly assigned U.S. Pat. No. 6,084,226 for the "Use of Continuously Variable Power in Microwave Assisted Chemistry," which is hereby incorporated by reference in its entirety.

The microwave instrument 10 typically includes a waveguide 13, which connects the microwave source 11 to the cavity 12. The waveguide 13 is typically formed of a material that reflects microwaves in a manner that propagates them to the cavity and that prevents them from escaping in any undesired manner. Typically, such material is an appropriate metal (e.g., stainless steel), which, other than its function for directing and confining microwaves, can be selected on the basis of its cost, strength, formability, corrosion resistance, or any other desired or appropriate criteria.

As is generally well understood in the art, for certain types of robust reactions such as digestion, a plurality of reactions can be carried out in a plurality of separate reaction vessels within a single microwave cavity. Accordingly, the microwave instrument 10 typically includes a turntable 16 positioned within the cavity 12. The turntable 16 typically has a plurality of reaction-vessel locations. The microwave instrument 10 may include a rotary encoder for determining the relative position (i.e., angular position) of turntable within the cavity 12.

Various types of reaction vessels 14 can be placed within the microwave cavity 12. Typically, a plurality of reaction vessels 14 can be placed in the microwave cavity 12. The reaction vessels 14 are formed of a material that is substantially transparent to microwave radiation. In other words, the reaction vessels 14 are typically designed to transmit, rather than absorb, microwave radiation.

Appropriate microwave-transparent materials include (but are not limited to) glass, quartz, and a variety of polymers. In the digestion context, engineering or other high-performance polymers are quite useful because they can be precisely formed into a variety of shapes and can withstand the temperatures and pressures generated in typical digestion reactions. Selecting the appropriate polymer material is well within the knowledge of the skilled person. Exemplary choices include (but are not limited to) polyamides, polyamide-imides, fluoropolymers, polyarylether ketones, self-reinforced polyphenylenes, poly phenylsulfones, and polysulfones. If the temperature and pressure requirements are less drastic, polymers with midrange performance can be selected, among which are polyvinyl chloride (PVC), polymethyl methacrylate (PMMA), acrylonitrile butadiene styrene (ABS), polyesters, and other similar compositions. In cases with very low performance requirements, polymers such as polystyrene, polypropylene and polyethylene may be acceptable.

The microwave instrument 10 is typically equipped with one or more reaction-vessel sensors 15 for identifying physical characteristics of reaction vessels 14 positioned within the cavity 12. For example, the reaction-vessel sensors 15 typically determine the number and type of reaction vessels 14 that are loaded into the cavity 12.

Figure 2:
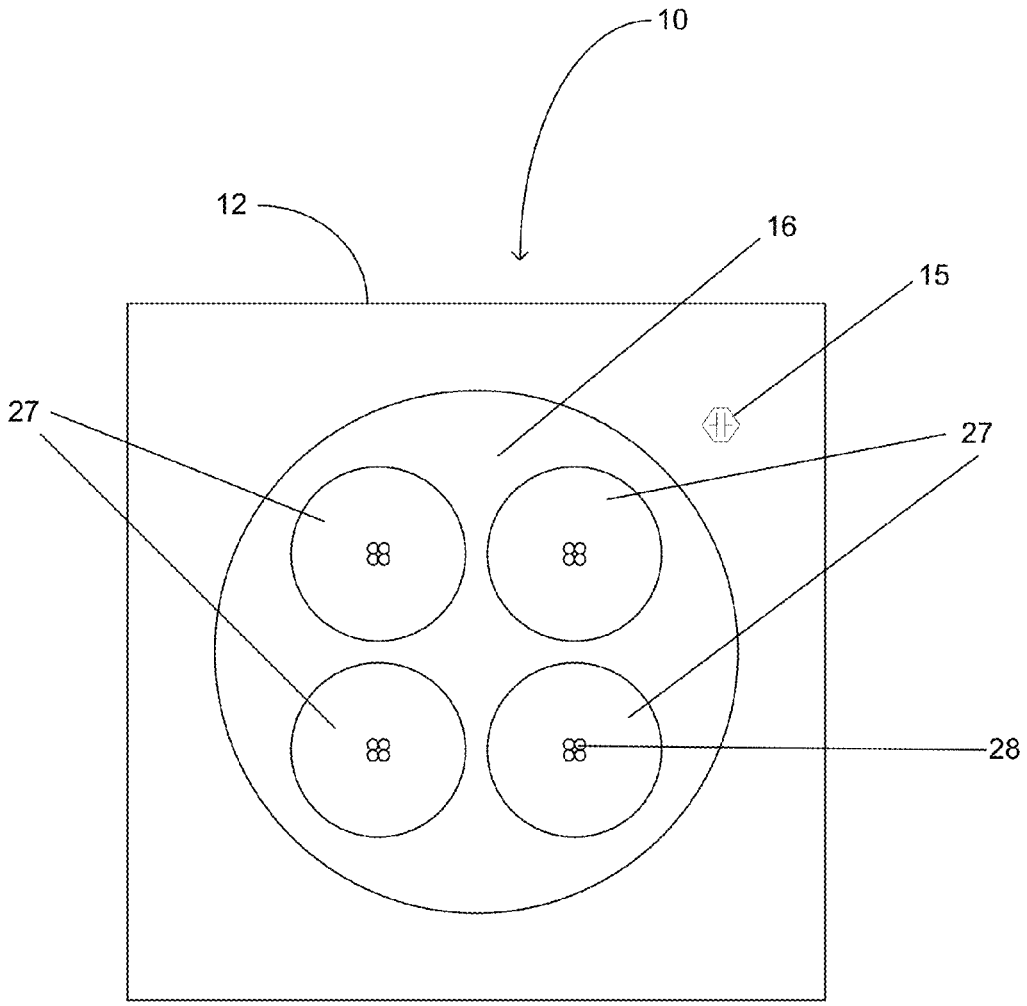
FIG. 2 depicts a portion of a microwave instrument in accordance with the present invention.

Various types of reaction-vessel sensors may be employed. For example, the reaction-vessel sensors may be optical sensors. In this regard, each vessel location 27 on the turntable 16 may have one or more holes 28 (e.g., as depicted in FIG. 2). The microwave instrument 10 depicted in FIG. 2 further includes one or more reaction-vessel sensors, one of which is illustrated as the reaction-vessel sensor 15. In particular, FIG. 2 includes one or more optical sensors (e.g., an optical-through-beam detector) for detecting if one or more of the holes 28 are plugged.

A basic through-beam sensor includes a transmitter and a separate receiver. The transmitter typically produces light in the infrared or visible portions of the spectrum and the light is detected by the corresponding receiver. If the beam to the receiver is interrupted (e.g., by a reaction vessel) the receiver produces a switched signal. In another version referred to as a retro-reflective sensor, the transmitter and receiver are incorporated into one housing and the system includes a reflector to return the transmitted light to the receiver. An object in the beam path again triggers the switching operation. As yet another option, a diffuse reflection sensor incorporates a transmitter and receiver in a single housing, but in operation the object to be detected reflects sufficient light for the receiver to generate the appropriate signal. Such devices typically have ranges from 150 millimeters to as much as 80 meters. Accordingly, an appropriate through beam system can be selected and incorporated by the skilled person without undue experimentation.

Typically, the reaction-vessel sensors 15 are located at a fixed position within the cavity 12. That said, the reaction-vessel sensors 15 may be located in any appropriate position that enables each sensor 15 to carry out its detection function (e.g., by detecting if one or more of the holes 28 at each reaction-vessel location 27 are plugged).

Each reaction vessel 14 may include one or more protrusions (e.g., located on the bottom of the reaction vessel) for plugging one or more of the holes 28 on the turntable 16. The number and location of protrusions on a reaction vessel 14 may correspond to the type (e.g., size) of reaction vessel. The reaction-vessel sensors 15 detect which, if any, holes 28 are plugged at each reaction vessel location 27 on the turntable 16. Accordingly, the reaction-vessel sensors 15 (e.g., optical sensor) can be used to determine the number and types of reaction vessels located on the turntable 16.

In an alternative embodiment, one or more bar-code readers may be employed for reading bar codes that designate the type of reaction vessel. FIG. 1 depicts each of the reaction vessels 14 as having a barcode 17 that can be read by the reaction-vessel sensor 15.

In another alternative embodiment, one or more RFID (radio-frequency identification) readers may be employed for reading an RFID tag that designates the type of reaction vessel. For example, each reaction vessel may include an active, semi-passive, or passive RFID tag.

In yet another embodiment, each reaction vessel may include one or more lights (e.g., light emitting diodes), which identify the type of reaction vessel. A photodetector (e.g., photodiode) can be used to detect the presence and type of such reaction vessels.

In a further embodiment, the microwave instrument may initially heat the reaction vessels using microwave power, typically low microwave power. Alternatively, the reaction vessels can be heated before they are placed in the microwave instrument. This initial heating of the reaction vessels should increase their temperature above the ambient air temperature. Accordingly, one or more infrared sensor can be used to detect the presence, and thus number, of reaction vessels. What is more, each type of reaction vessel typically has a unique infrared profile. Therefore, the infrared sensor can also be used to determine the type of reaction vessel by matching the measured infrared profile with the expected infrared profile of a particular type of reaction vessel.

Other types of reaction-vessel sensors are within the scope of the present invention, provided they do not undesirably interfere with the operation of the microwave instrument.

In some embodiments, one or more weight sensors 18 may be positioned within the cavity 12. The weight sensors may be used to detect the weight of material (e.g., sample weight) within a reaction vessel. By way of example, the weight sensor can be a balance, scale, or other suitable device.

The microwave instrument typically includes an interface 20 and a computer controller 21.

The interface 20 allows a user of the microwave instrument 10 to specify the type of reaction to be performed by the microwave instrument. The interface 20 typically includes a display 22 and one or more input devices 23. Any appropriate input devices may be employed including, for example, buttons, touch screens, keyboards, a computer "mouse," or other input connections from computers or personal digital assistants. The display 22 is most commonly formed of a controlled or addressable set of liquid crystal displays (LCDs). That said, the display may include a cathode ray tube (CRT), light emitting diodes (LEDs), or any other appropriate display medium.

The computer controller 21 is typically in communication with the interface 20, the source of microwave radiation 11, and the reaction-vessel sensors 15. The computer controller 21 is also typically in communication with other devices within the microwave instrument, such as the weight sensor and the rotary encoder. The computer controller 21 is typically used to control (e.g., adjust) the application of microwaves (e.g., from the microwave source 11), including starting them, stopping them, or moderating them, within the microwave instrument 10 in response to information received from a sensor (e.g., the reaction-vessel sensors 15). In this regard, the computer controller 21 typically includes a processor, memory, and input/output interfaces. The operation of controllers and microwave processors is generally well understood in the appropriate electronic arts, and will not be otherwise described herein in detail. Exemplary discussions are, however, set forth, for example, in Dorf, *The Electrical Engineering Handbook,* 2d Edition (1997) by CRC Press at Chapters 79-85 and 100.

The computer controller 21 includes a stored relationship between the number and type of reaction vessels and the microwave power required to perform a particular reaction (e.g., a particular digestion reaction, such as nitric-acid digestion of organic material) according to a predefined method (e.g., an algorithm), illustrated schematically in FIG. 1 at 24. The computer controller 21 typically includes (e.g., in ROM memory) a plurality of predefined methods, each relating to a particular reaction. These previously stored relationships enable the computer controller 21 to modulate the microwave power in response to data received from the reaction-vessel sensors 15 (e.g., the number and type of reaction vessels).

Additional sensors may be connected to the computer controller 21 to provide feedback information (e.g., temperature and pressure within a reaction vessel 14) during a reaction.

For example, the microwave instrument 10 may include one or more pressure sensors 25. The pressure sensors 25 may include an optical pressure sensor. An exemplary optical pressure sensor is disclosed in German Patent DE 19710499, which is hereby incorporated by reference in its entirety.

By way of further example, one or more temperature sensors 26, such as an infrared sensor (e.g., an optical pyrometer), for detecting the temperature within a reaction vessel 14 may be positioned within the microwave instrument 10. Other types of temperatures sensors 26, such as a thermocouple, are also within the scope of the present invention.

Pressure sensing is typically carried out by placing a transducer (not shown) at an appropriate position either within or adjacent a reaction vessel so that pressure generated in the vessel either bears against or is transmitted to the transducer which in turn generates an electrical signal based upon the pressure. The nature and operation of pressure transducers is well understood in the art and the skilled person can select and position the transducer as desired and without undue experimentation.

The computer controller 21 may be programmed to further modulate microwave power in response to this feedback information (e.g., information received from a pressure sensor and/or a temperature sensor).

By way of example, each predefined reaction method may include ideal temperature information. For example, the predefined reaction method may include a relationship between ideal temperature and time (e.g., a function of ideal temperature within a reaction vessel versus time). Furthermore, the predefined reaction method may include a relationship between ideal temperature and microwave power. The computer controller 21 may compare the ideal temperature against the measured temperature within a reaction vessel. The computer controller 21 may then adjust microwave power in order to minimize the difference between ideal temperature and measured temperature.

The interface 20 enables a user to select a programmed reaction (e.g., a digestion or synthesis reaction) for the microwave instrument to perform. For example, the interface 20 may include a touch-screen interface with icons corresponding to particular types of reactions. The availability, programming, and use of such touch screens are well understood in this art and will not be otherwise described in detail.

After a user selects the desired reaction, the interface 20 transmits this information to the computer controller 21. The computer controller 21 then selects the appropriate preprogrammed method corresponding to the user-selected reaction. In effect, all the user needs to specify is the desired reaction (e.g., with a single touch of the user interface); the user need not specify other relevant variables considered by the computer controller (e.g., type of reaction vessels, number of reaction vessels, and/or temperature within the reaction vessels).

In another aspect of the present invention, the computer controller typically includes a learning mode. In the learning mode, the computer controller determines the difference between the preprogrammed relationship between ideal temperature and microwave power (e.g., an ideal temperature vs. microwave power curve) and the actual relationship between temperature and microwave power during a user-selected reaction. The computer controller may then use the difference (sometimes referred to as the "error") between the ideal and actual relationships to modify the preprogrammed method corresponding to the user-selected reaction to minimize this error in successive reactions. In other words, computer controller modifies the preprogrammed method so that the actual temperature vs. power relationship produced by successive reactions more closely follows the ideal relationship.

By way of example, the learning mode can be used to minimize the temperature error (i.e., the error between the actual and ideal temperature vs. power curves) at the end of a microwave ramp, thereby maximizing the time that the actual reaction temperature is at the predefined, ideal hold temperature (or temperature range), albeit within predefined error bounds.

The computer controller may be placed in the learning mode by the user each time the user-selected reaction is performed. Accordingly, the preprogrammed method may be continuously refined to minimize the difference between the actual and ideal temperature vs. power curves so that the instrument operates more efficiently as more reactions are carried out.

Figure 3:
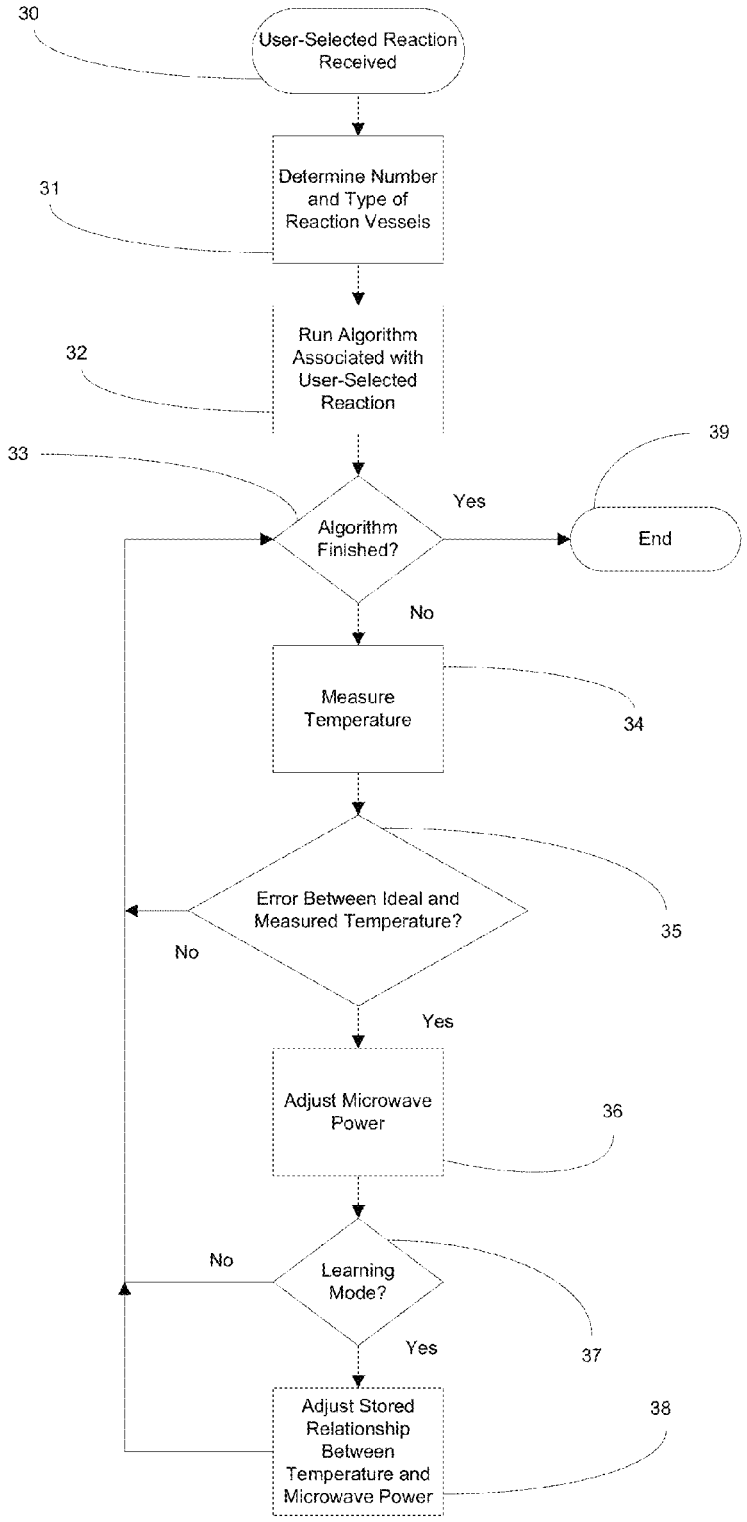
FIG. 3 depicts a flowchart of an exemplary method for operating the computer controller in accordance with the present invention.

FIG. 3 depicts a flowchart of an exemplary method for operating the computer controller 21. First, at step 30, the interface 20 sends a user-selected reaction to the computer controller 21. Next, at step 31, the computer controller 21 communicates with the reaction-vessel sensor(s) 15 to determine the number and type of reaction vessels. At step 32, the computer controller 21 runs the algorithm associated with the user-selected reaction.

At step 33, the computer controller 21 assesses whether the algorithm has finished running. If the algorithm has finished, the controller 21 terminates the method at step 39. If the algorithm has not finished, the computer controller 21 proceeds to determine the temperature within the reaction vessels (e.g., using the temperature sensor 26) at step 34. At step 35, the computer controller 21 calculates whether there is any error between the measured temperature and the ideal temperature. If error is present, the computer controller 21 will adjust the microwave power at step 36 (e.g., by adjusting the output of the microwave-radiation source 11 or by moderating the transmission of microwaves between the source and the cavity).

At step 37, the computer controller 21 assesses whether or not its learning mode has been enabled. If the learning mode has been enabled, at step 38, the computer controller 21 adjusts the stored relationship between temperature and microwave power, thereby reducing error in subsequent reactions.

Figure 4:
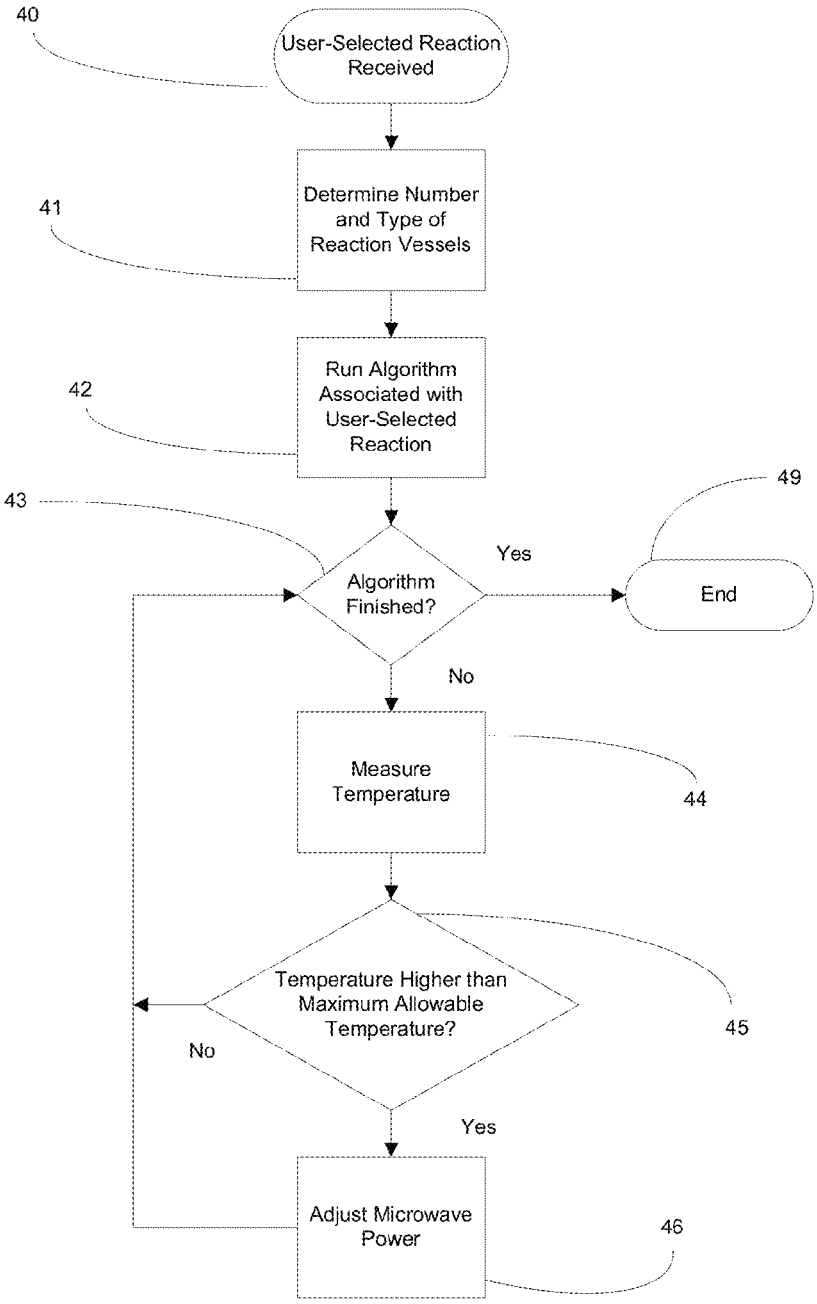
FIG. 4 depicts a flowchart of another exemplary method for operating the computer controller in accordance with the present invention.

FIG. 4 depicts a flowchart of another exemplary method for operating the computer controller 21. First, at step 40, the interface 20 sends a user-selected reaction to the computer controller 21. Next, at step 41, the computer controller 21 communicates with the reaction-vessel sensor(s) 15 to determine the number and type of reaction vessels. At step 42, the computer controller 21 runs the algorithm associated with the user-selected reaction.

At step 43, the computer controller 21 assesses whether the algorithm has finished running. If the algorithm has finished, the controller 21 terminates the method at step 49. If the algorithm has not finished, the computer controller 21 proceeds to determine the temperature within the reaction vessels (e.g., using the temperature sensor 26) at step 44.

Unlike the method depicted in FIG. 3, this method does not include the step of determining whether there is any error between the measured temperature and the ideal temperature. Rather, at step 45, the computer controller 21 calculates whether the measured temperature is higher than a maximum allowable temperature. By way of example, the maximum allowable temperature may correspond to the ideal hold temperature at the end of a microwave ramp. Alternatively, the maximum allowable temperature may be determined with safety in mind.

If the temperature is too high, the computer controller 21 will adjust the microwave power at step 46 (e.g., by adjusting the output of the microwave-radiation source 11 or by moderating the transmission of microwaves between the source and the cavity).

A microwave instrument in accordance with the present invention helps to reduce operator error, and thus improves the convenience, safety, and efficiency of performing microwave-assisted reactions.

In the specification and drawings, typical embodiments of the invention have been disclosed. The present invention is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The invention claimed is:

1. An instrument for performing microwave-assisted reactions, comprising:

a microwave-radiation source;

a cavity;

a waveguide in microwave communication with said microwave-radiation source and said cavity;

at least one reaction-vessel sensor selected from the group consisting of bar code readers and RFID readers for identifying reaction vessels positioned within said cavity that include items selected from the group consisting of bar codes and RFID tags;

an interface; and a computer controller in communication with said interface, said microwave-radiation source, and said reaction-vessel sensor, said computer controller being capable of adjusting the output of said microwave-radiation source in response to the number and/or type of reaction vessels that said reaction-vessel sensor determines are positioned within said cavity;

wherein said reaction-vessel sensor determines the number and type of reaction vessels positioned within said cavity; and wherein said computer controller is capable of adjusting the output of said microwave-radiation source in response to the number and type of reaction vessels that said reaction-vessel sensor determines are positioned within said cavity.

2. An instrument for performing microwave-assisted reactions according to claim 1, further comprising at least one temperature sensor in communication with said computer controller for detecting the temperature within a reaction vessel positioned within said cavity, and wherein said computer controller is capable of adjusting the output of said microwave-radiation source in response to temperature data received from said temperature sensor.

3. An instrument for performing microwave-assisted reactions according to claim 1, further comprising at least one pressure sensor in communication with said computer controller for detecting the pressure within a reaction vessel positioned within said cavity.

4. An instrument for performing microwave-assisted reactions according to claim 3, wherein said computer controller is capable of adjusting the output of said microwave-radiation source in response to pressure data received from said pressure sensor.

5. An instrument for performing microwave-assisted reactions according to claim 1, further comprising one or more reaction vessels that are substantially transparent to microwave radiation and that include items selected from the group consisting of bar codes and RFID tags.

6. An instrument for performing microwave-assisted reactions according to claim 1, further comprising a turntable positioned within said cavity that defines a plurality of reaction-vessel locations.

7. An instrument for performing microwave-assisted reactions according to claim 6, wherein:

said turntable defines a plurality of holes at least one of said reaction-vessel locations; and said reaction-vessel sensor comprises at least one optical sensor for detecting if one or more of the holes are plugged by a reaction vessel.

8. An instrument for performing microwave-assisted reactions according to claim 1, further comprising at least one weight sensor for detecting the sample weight within a reaction vessel.

9. An instrument for performing microwave-assisted reactions according to claim 1, wherein said computer controller includes a stored relationship between the number and type of reaction vessels and the microwave power required to perform one or more reactions.

* * * * *